US008526648B2

(12) United States Patent
Dijkstra et al.

(10) Patent No.: US 8,526,648 B2
(45) Date of Patent: Sep. 3, 2013

(54) SYSTEM AND METHOD FOR PROVIDING HEARING ASSISTANCE TO A USER

(75) Inventors: Evert Dijkstra, Fontaines (CH); Francois Callias, Fontaines (CH); Stefan Haenggi, Bern (CH); Francois Marquis, Corminboeuf (CH)

(73) Assignee: Phonak AG, Staefa (CH)

( * ) Notice: Subject to any disclaimer, the term of this patent is extended or adjusted under 35 U.S.C. 154(b) by 153 days.

(21) Appl. No.: 12/523,970

(22) PCT Filed: Jan. 22, 2007

(86) PCT No.: PCT/EP2007/000511
§ 371 (c)(1),
(2), (4) Date: Jan. 18, 2010

(87) PCT Pub. No.: WO2008/089784
PCT Pub. Date: Jul. 31, 2008

(65) Prior Publication Data

US 2010/0128907 A1 May 27, 2010

(51) Int. Cl.
*H04R 25/00* (2006.01)

(52) U.S. Cl.
USPC ..... 381/315; 381/312; 381/314

(58) Field of Classification Search
None
See application file for complete search history.

(56) References Cited

U.S. PATENT DOCUMENTS

| | | | | |
|---|---|---|---|---|
| 5,991,419 | A * | 11/1999 | Brander | 381/312 |
| 6,549,633 | B1 | 4/2003 | Westermann | |
| 7,580,535 | B2 * | 8/2009 | Baechler | 381/315 |
| 8,019,386 | B2 * | 9/2011 | Dunn et al. | 455/563 |
| 2004/0013280 | A1 | 1/2004 | Niederdrank | |
| 2004/0037442 | A1 | 2/2004 | Nielsen et al. | |
| 2004/0175008 | A1 | 9/2004 | Roeck et al. | |
| 2004/0252852 | A1 | 12/2004 | Taenzer | |
| 2005/0100182 | A1 | 5/2005 | Sykes et al. | |
| 2005/0117764 | A1 | 6/2005 | Arndt et al. | |
| 2006/0067550 | A1 | 3/2006 | Puder et al. | |

FOREIGN PATENT DOCUMENTS

| | | | |
|---|---|---|---|
| CA | 2 422 449 | A1 | 3/2003 |
| EP | 1 531 650 | A2 | 5/2005 |
| EP | 1 651 005 | A2 | 4/2006 |
| EP | 1 657 958 | A1 | 5/2006 |
| WO | 96/41498 | A1 | 12/1996 |
| WO | 02/074011 | A2 | 9/2002 |

* cited by examiner

*Primary Examiner* — Duc Nguyen
*Assistant Examiner* — Taunya McCarty
(74) *Attorney, Agent, or Firm* — Roberts Mlotkowski Safran & Cole, P.C.; David S. Safran

(57) ABSTRACT

A hearing assistance system, having an audio signal source, a transmission unit for transmitting audio signals from the audio signal source via a wireless right ear audio link to a right ear unit and a receiver unit, and an arrangement for stimulating the user's right ear, and via a wireless left ear audio link, a left ear unit having a receiver unit and an arrangement for stimulating the user's left ear, an arrangement for exchanging audio signals received from the transmission unit between the right and left ear units, a device for detecting the quality of the right and left ear links and an arrangement for selecting, as a function of the detected qualities of the right and left ear links, as input to the stimulating arrangement, the audio signals received by the respective receiver unit from the transmission unit, the audio signals received via the audio signal exchanging arrangement, and/or mixtures thereof.

23 Claims, 2 Drawing Sheets

SYSTEM AND METHOD FOR PROVIDING HEARING ASSISTANCE TO A USER

BACKGROUND OF THE INVENTION

1. Field of the Invention

The present invention relates to a system and a method for providing hearing assistance to a user wherein audio signals from an audio signal source, which usually is a microphone arrangement, are transmitted by a transmission unit via a wireless audio link to a right ear unit and a left ear unit which are worn at or at least in part in the user's right ear and left ear, respectively, and which comprise means for stimulating the respective user's ear according to the transmitted audio signals.

2. Description of Related Art

Usually in such systems the wireless audio link is an FM (Frequency Modulation) radio link. The benefit of such systems is that sound captured by a remote microphone at the transmission unit can be presented at high sound pressure level to the hearing of the user wearing the ear units. In particular, the level of speech signals from the person using the transmission unit can be increased with regard to acoustic background noise.

A typical application of wireless audio systems the receiver unit is connected to or integrated into a hearing instrument, such as a hearing aid. The benefit of such systems is that the microphone of the hearing instrument can be supplemented or replaced by the remote microphone which produces audio signals which are transmitted wirelessly to the FM receiver and thus to the hearing instrument. In particular, FM systems have been standard equipment for children with hearing loss in educational settings for many years. Their merit lies in the fact that a microphone placed a few inches from the mouth of a person speaking receives speech at a much higher level than one placed several feet away. This increase in speech level corresponds to an increase in signal-to-noise ratio (SNR) due to the direct wireless connection to the listener's amplification system. The resulting improvements of signal level and SNR in the listener's ear are recognized as the primary benefits of FM radio systems, as hearing-impaired individuals are at a significant disadvantage when processing signals with a poor acoustical SNR.

Most FM systems in use today provide two or three different operating modes. The choices are to get the sound from: (1) the hearing instrument microphone alone, (2) the FM microphone alone, or (3) a combination of FM and hearing instrument microphones together.

Usually, most of the time the FM system is used in mode (3), i.e. the FM plus hearing instrument combination (often labeled "FM+M" or "FM+ENV" mode). This operating mode allows the listener to perceive the speaker's voice from the remote microphone with a good SNR while the integrated hearing instrument microphone allows to listener to also hear environmental sounds. This allows the user/listener to hear and monitor his own voice, as well as voices of other people or environmental noise, as long as the loudness balance between the FM signal and the signal coming from the hearing instrument microphone is properly adjusted.

An example of an FM system is found in Canadian 2 422 449 A1 wherein the FM receiver unit is mechanically connected to a hearing instrument.

Such FM systems often are used in rooms. However, due to reflections in rooms the quality of the reception of the FM audio signals will vary depending upon head movement, position of the user in the room, positions and movement of other people or objects, etc. This varying quality manifests itself by a kind of a hissing noise and is especially noticeable in very small FM receivers as these receivers are built with very small antennas. These "holes" in the FM audio signal reception quality are an issue both with the current analogue FM systems as well as with the upcoming new digital systems.

Further, binaural hearing systems are already available, wherein there is provided a usually wireless link between the right ear hearing aid and the left ear hearing aid for exchanging data and audio signals between the hearing aids for improving binaural perception of sound. Examples of such binaural systems can be found in European Patent Application 1 651 005 A2, U.S. Patent Application Publication 2004/0037442 A1 and U.S. Pat. No. 6,549,633 B1. In European Patent Application 1 531 650 A2 a binaural system is described wherein in addition to the binaural link a wireless audio link to a remote microphone is provided. A similar system is described in WO 02/074011 A2.

European Patent Application 1 657 958 A1 relates to a communication system comprising a plurality of hearing aids between which audio signals may be exchanged via wireless links.

U.S. Patent Application Publication 2005/0117764 A1 relates to a system comprising a right ear hearing aid and left ear hearing aid, each comprising a hearing coil for receiving audio signals from a telephone. The difference between the levels of the input signals of the two hearing devices at the hearing coils is measured and compared with a threshold value. If the difference in levels drops below or exceeds the threshold value, the respective hearing aid is switched to a telephone mode.

U.S. Patent Application Publication 2004/0252852 A1 relates to a binaural acoustic beam forming system comprising a right ear hearing aid and a left ear haring aid wherein the voice-to-background noise ratio of the audio signal captured by the microphone of the right ear hearing aid and the audio signal captured by the microphone of the left ear hearing aid is determined and compared and wherein these audio signals are mixed prior to being supplied to the respective loudspeaker of the hearing aids, with the mixing ratio depending on the noise power ratio, i.e. the ratio of the voice to background noise ratios of the left ear hearing aid and the right ear hearing aid, respectively.

SUMMARY OF THE INVENTION

It is a first object of the invention to provide for a hearing assistance system wherein audio signals from a remote audio signal source are provided wirelessly to both ears of the user and wherein the quality of the audio signal transmission should be optimized.

It is a second object of the invention to provide for a hearing assistance system wherein audio signals from a remote audio signal source are provided wirelessly to both ears of the user and wherein the system should be particularly economic.

According to the invention the first object is achieved by a system and a method according to the invention. This solution is beneficial in that, by detecting the quality of the right ear link and the left ear link and exchanging audio signals received from the transmission unit between the right ear unit and the left ear unit in order to select, as a function of the detected qualities of the right ear link and the left ear link, as input to the stimulating means the audio signal received by the respective receiver unit directly from the transmission unit, the audio signals received via the audio signal exchange between the right ear unit and the left ear unit and/or mixtures thereof, the quality of the audio signals transmitted from the transmission unit to any of the two ear units can be optimized, since a poor transmission quality of one of the audio links can be compensated by supplying the audio signal transmitted via the audio link having the better quality to both ear units via the audio signal exchange between the ear units. In particular, it is thereby made possible to always select the presently better one of the right ear audio link and the left ear audio link (i.e., the one having a higher degree of qualitative excellence) to be input to both the right ear unit and the left ear unit.

In some cases it may be sufficient to use a mixture of the audio signals received via the right ear audio link and the left ear audio link. If both audio links have sufficient quality, no exchange of audio signals between the right ear unit and the left ear unit is necessary. However, in this case it would be possible to use only one of the two audio links and to transmit the audio signals received via this link to the other ear unit, while the other one of the audio links is turned off in order to save power.

According to the invention, the second object is achieved by a system and a method as described herein and which is beneficial in that, by transmitting audio signals received from the transmission unit by one of the ear units to the other one of the ear units via a second wireless audio link, it is sufficient to equip only one of the ear units with a receiver unit for the audio signals transmitted from the transmission unit via the first wireless audio link, so that system complexity can be reduced in order to provide for a more economic system, while nevertheless the audio signals transmitted by the transmission unit can be provided at both ears of the user.

These and further objects, features and advantages of the present invention will become apparent from the following description when taken in connection with the accompanying drawings which, for purposes of illustration only, show several embodiments in accordance with the present invention.

DETAILED DESCRIPTION OF THE INVENTION

Figure 1:
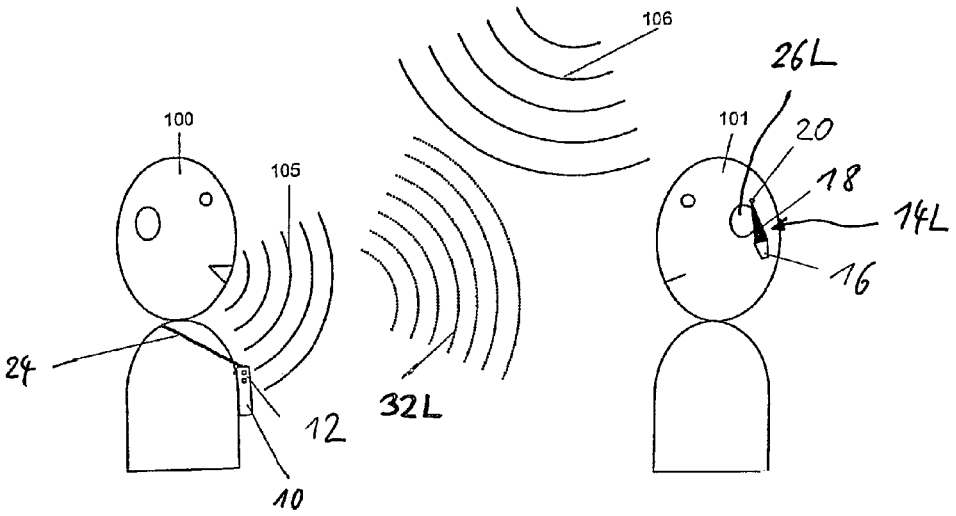
FIG. 1 is a schematic view of the use of a hearing assistance system according the invention.
Figure 2:
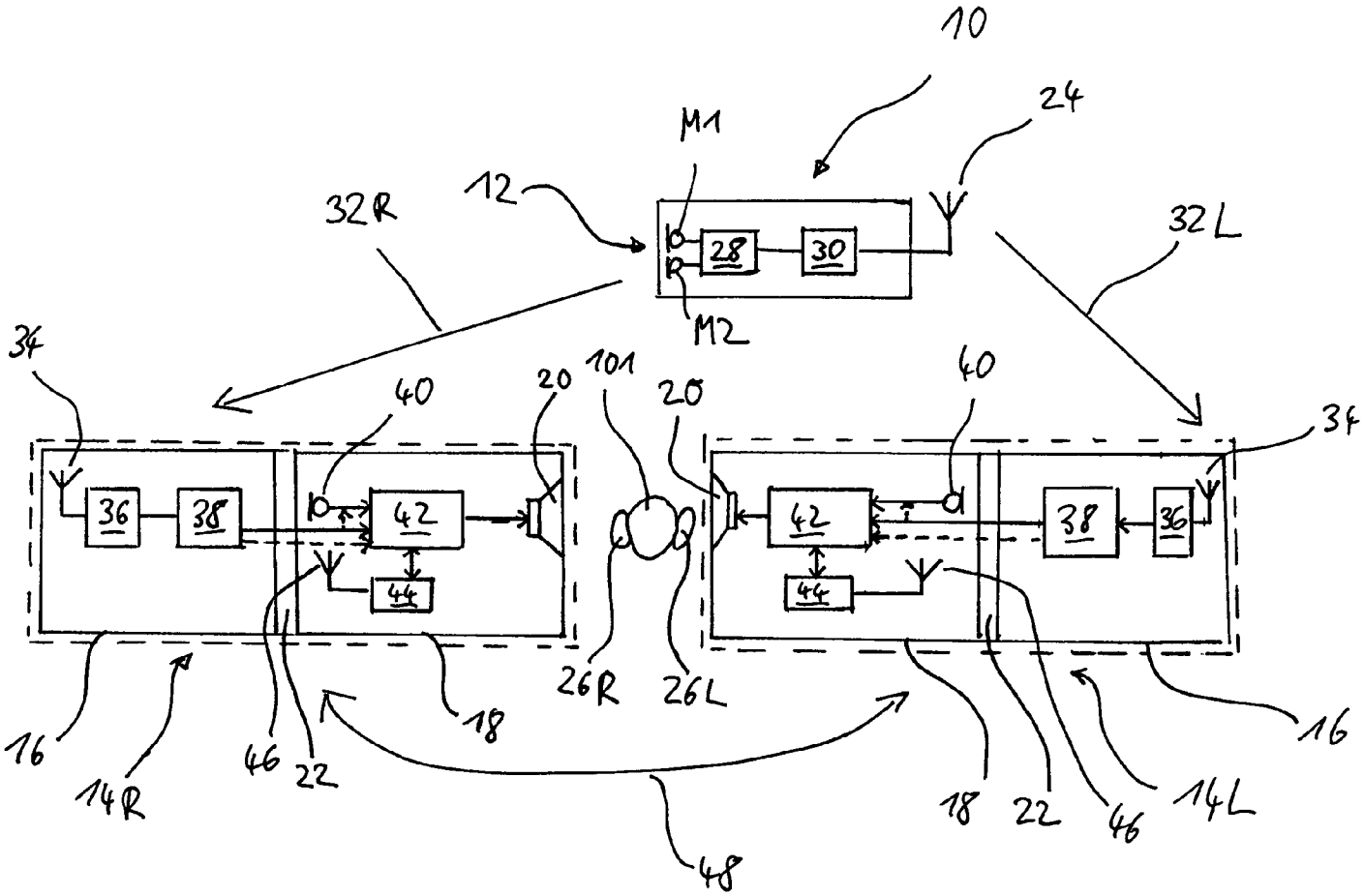
FIG. 2 is a block diagram of a first embodiment of a hearing assistance system according to the invention.

FIGS. 1 and 2 show a hearing assistance system comprising a transmission unit 10 comprising a directional microphone arrangement 12 consisting of two omnidirectional microphones M1 and M2 which are spaced apart, a right ear unit 14R and a left ear unit 14L, each comprising a receiver unit 16 and a hearing instrument 18. The hearing instrument 18 comprises a loudspeaker 20. The hearing instrument 18 and the receiver unit 16 may be connected by a mechanical/electrical interface 22 (for example, a so-called "audio shoe"), or they may be integrated into a common housing (as indicated by dashed lines in FIG. 2). The hearing aid 18 could be of any type, for example, BTE (Behind-The-Ear), ITE (In-The-Ear) or CIC (Completely-In-the-Channel). The transmission unit 10 may be worn by a speaker 100 around his neck by a neck loop 24 acting as an antenna, with the microphone arrangement 12 capturing the sound waves 105 carrying the speaker's voice. The right ear unit 14R is worn at or at least in part in the right ear 26R of the user 101, and the left ear unit 14L is worn at or at least in part in the left ear 26L of the user 101. In addition to the voice 105 of the speaker 100 background/surrounding noise 106 may be present.

The transmission unit 10 comprises an audio signal processing unit 28 for processing the audio signals captured by the microphone arrangement 12 and a transmitter 30 for transmitting the processed audio signals via the antenna 24 via a left ear audio link 32L to the receiver unit 16 of the left ear unit 14L and via a right ear audio link 32R to the receiver unit 16 of the right ear unit 14R.

Each receiver unit 16 comprises an antenna 34, a receiver 36 and an audio signal processing unit 38 for processing the audio signals received by the receiver 36 via the respective audio link 32R, 32L. Each hearing instrument 18 comprises a microphone arrangement 40 (which may comprises a single microphone or two spaced apart microphones) for capturing audio signals at the respective user's ear 26R, 26L, a central unit 42, the loudspeaker 20, a transceiver 44 and a corresponding antenna 46. The transceiver 44 and the antenna 46 are provided for establishing a binaural link 48 between the hearing instruments 18 of the right ear unit 14R and the left ear unit 14L, respectively, which serves to exchange audio signals and control data/commands between the right ear unit 14R and the left ear unit 14L. In particular, the binaural link 48 serves to exchange audio signals received by the receiver units 16 of the right ear unit 14R and the left ear unit 14L, respectively.

The central unit 42 serves to process the audio signals received from the built-in microphone arrangement 40, the audio signals supplied by the respective receiver unit 16 and the audio signals received by the transceiver 44 via the binaural link 48 from the hearing instrument 18 of the other one of the right ear unit 14R and the left ear unit 14L, respectively. The central unit 42 also serves to control the respective right ear unit 14R and left ear unit 14L. The processed audio signals are supplied from the central unit 42 to the speaker 20 for stimulating the respective ear 26R, 26L.

In each of the right ear unit 14R and the left ear unit 14L the quality of the respective right ear audio link 32R and the left ear audio link 32L is monitored. This can be done, for example, by a signal-to-noise-ratio (SNR) measurement of the signals received by the receiver unit 16, by an RSSI (Received Signal Strength Indication) measurement (wherein the energy integral of the signal received by the receiver unit 16 is determined) or, if the links 32R, 32L are digital, by error-rate measurements. Such link quality monitoring may be carried-out in the receiver unit 16 (for example, by the audio signal processing unit 38) or in the hearing instrument 18 (for example, by the central unit 42 to which the signal received by the receiver unit 16 is supplied). If the link quality is monitored in the receiver unit 16, the result of the analysis has to be supplied to the hearing instrument 18, see dashed line in FIG. 2.

The result of the link quality monitoring is used for improving the quality of the audio signals transmitted by the transmission unit 10 in case that one of the right ear audio link 32R and the left ear audio link 32L has a significantly lower quality than the other one. To this end, in this case the audio signals received via one of the links 32R, 32L presently having the higher quality are transmitted via the binaural link 48 to the other one of the units 14R, 14L, and there they are used to replace or at least supplement the audio signals received by the receiver unit 16 of that unit 14R, 14L via that one of the links 32R, 32L presently having the lower quality, prior to being supplied as input to the respective loudspeaker 20. Consequently, both the transmission/exchange of audio signals via the binaural link 48 and the selection of the audio signals to be supplied as input to the loudspeaker 20 are controlled according to result of the monitoring of the quality of the audio links 32R, 32L.

Practically, such control can be achieved by designing the system architecture such that one of the units 14R, 14L acts as a master and the other one acts as a slave, with the necessary information regarding the quality of the respective audio link 32R, 32L being exchanged/transmitted via the binaural link 48 from the slave to the master and with corresponding control commands being transmitted via the binaural link 48 from the master to the slave.

The selection of the audio signals which are supplied as input to the loudspeaker 20 is carried out by the central unit 42 of the hearing instrument 18 acting as the master; i.e. the decision is made by the central unit 42 of the master and corresponding control commands, if necessary, are transmitted via the binaural link 48 to the central unit 42 of the hearing instrument 18 of the other one of the units 14R, 14L.

According to a preferred embodiment the binaural link 48 is established once the quality of at least one of the units 32R, 32L has been found to be below a pre-set threshold value, and the audio signals received via the better one of the links 32R, 32L is supplied via the binaural link 48 to that one of the units 14R, 14L having the worse link 32R, 32L where these audio signals are used to replace or at least supplement the audio signals received via the worse one of the links 32R, 32L.

According to a modified embodiment it would be possible to turn-off the worse one of the links 32R, 32L as long as the better one of the links 32R, 32L has a quality above the pre-set threshold value in order to save power in the respective receiver unit 16.

Preferably the audio links 32R, 32L are radio frequency links, such as an analog FM link. However, according to an alternative embodiment the links 32R, 32L may be digital audio links. The binaural link 48 preferably is a digital link, for example, a FSK (Frequency-Shift-Keying) modulated link.

Figure 3:
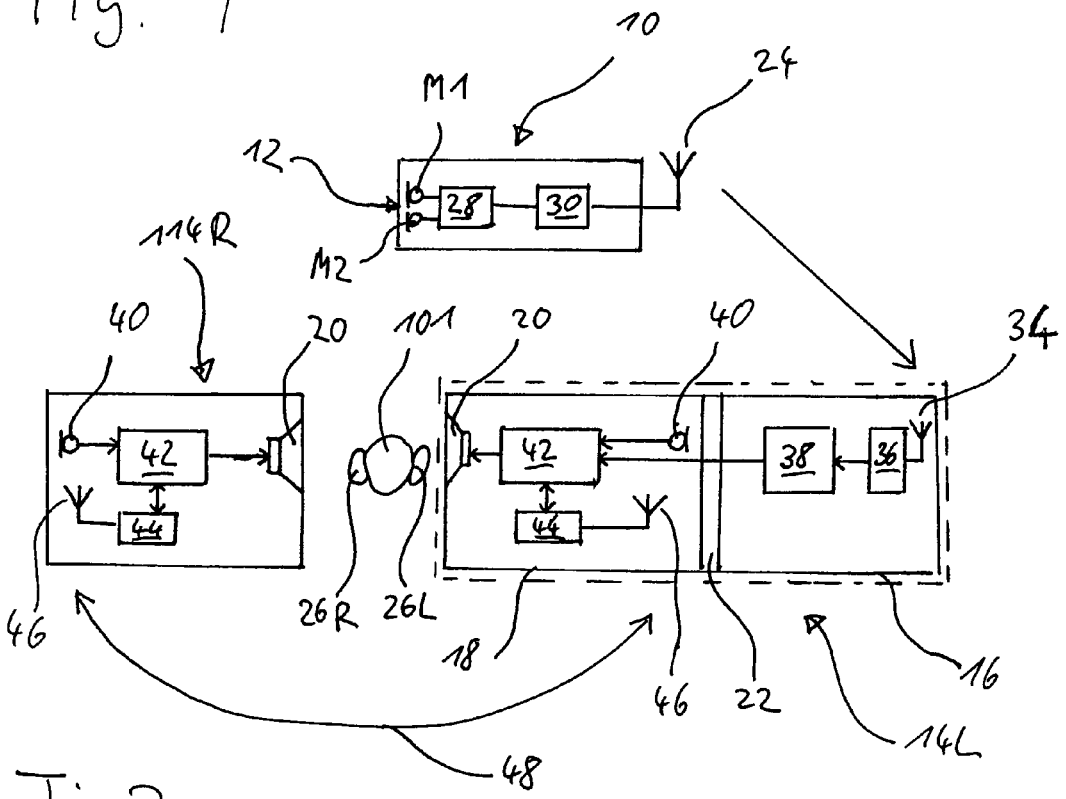
FIG. 3 is a block diagram of a second embodiment of a hearing assistance system according to the invention.

An alternative embodiment of the invention is shown in FIG. 3, wherein only one of the ear units (for example, the left ear unit 14L) is provided with a receiver unit 16 for the audio link 32L from the transmission unit 10, whereas the other one of the ear units (in the example of FIG. 3 the right ear unit 114R) does not comprise a receiver unit for the audio signals transmitted from the transmission unit 10, so that the right ear unit 114R comprises only a hearing instrument 18. According to this embodiment, the audio signals received by the left ear unit 14L via the audio link 32L from the transmission unit 10 are permanently supplied via the binaural link 48 to the hearing instrument 18 of the right ear unit 114R in order to supply the audio signals transmitted by the transmission unit 10 via the link 32L and the binaural link 48 to the loudspeaker 20 of the right ear unit 114R. Thereby for binaural hearing instruments 18 capable of establishing a binaural link 48 the need for a second receiver unit 16 for receiving audio signals directly from the transmission unit 10 is eliminated, whereby system complexity is reduced.

Depending on the type of the hearing instrument 18, the output if the receiver unit 16 may be connected to a separate high impedance audio input of the hearing instrument 18, as shown in FIGS. 2 and 3, or it may connected to a low impedance audio input of the hearing instrument 18 which is connected in parallel to the microphone 40 (see dashed lines in FIGS. 2 and 3).

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as encompassed by the scope of the appended claims.

What is claimed is:

1. A system for providing hearing assistance to a user, comprising:

an audio signal source, a transmission unit, adapted to be carried by a user at a distance from the user's ears, for transmitting audio signals from the audio signal source via a wireless right ear audio link to a right ear unit to be worn at or at least in part in a user's right ear, the unit for the right ear comprising a receiver unit and means for stimulating the user's right ear and via a wireless left ear audio link to a left ear unit to be worn at or at least in part in the user's left ear, the unit for the left ear comprising a receiver unit and means for stimulating the user's left ear, means for exchanging audio signals received from the transmission unit between the right ear unit and the left ear unit, means for detecting the qualitative excellence of the right ear link and of the left ear link and means for selecting, as a function of the detected the qualitative excellence of the right ear link and the left ear link, as input to the means for stimulating the user's right ear and the means for stimulating the user's left ear, at least one of the audio signals received by the respective receiver unit from the transmission unit, the audio signals received via the audio signal exchanging means, and mixtures thereof.

2. The system of claim 1, wherein the means for exchanging audio signals between the right ear unit and the left ear unit is a means for establishing a wireless binaural audio link.

3. The system of claim 2, wherein the selecting means is integrated into the right ear unit and the left ear unit.

4. The system of claim 3, wherein one of the right ear unit and the left ear unit is for acting as a master unit and the other one is for acting as a slave unit in order to select the audio signals to be provided as input to each of the stimulating means, and wherein the right ear unit and the left ear unit comprise means for establishing a wireless data link for transmitting information regarding the qualitative excellence of the audio link from the transmission unit to the slave unit from the slave unit to the master unit and for transmitting control commands from the master unit to the slave unit.

5. The system of claim 4, wherein the means for exchanging audio signals received from the transmission unit between the right ear unit and the left ear unit comprises the means for establishing said wireless data link.

6. The system of claim 1, wherein each of the right ear unit and the left ear unit is a hearing instrument into which the receiver unit is integrated.

7. The system of claim 1, wherein the right ear unit and the left ear unit each comprises a hearing instrument which is connected to the receiver unit for being supplied with the audio signals received by the receiver unit.

8. The system of claim 6, wherein the means for exchanging audio signals between the right ear unit and the left ear unit is included in the hearing instruments.

9. The system of claim 6, wherein the means for detecting the qualitative excellence of the right ear link and of the left ear link is integrated into the respective receiver unit.

10. The system of claim 6, wherein the means for detecting the qualitative excellence of the right ear link and of the left ear link is integrated into the respective hearing instrument.

11. The system of claim 6, wherein each hearing instrument includes said stimulating means, a microphone arrangement for capturing audio signals and an audio signal processing unit for processing at least one of the audio signals captured by the microphone arrangement, the audio signals received by the receiver unit and the audio signals received from the other one of the right ear unit and the left ear unit.

12. The system of claim 1, wherein the audio signal source is a microphone arrangement integrated into or connected to the transmission unit.

13. A method of providing hearing assistance to a user, comprising:

generating audio signals by an audio signal source and transmitting said audio signals by a transmission unit located at a distance form a user's ears via a wireless right ear audio link to a right ear unit which is worn at or at least in part in a user's right ear and which comprises means for stimulating the user's right ear and via a wireless left ear audio link to a left ear unit which is worn at or at least in part in a user's left ear and which comprises means for stimulating the user's left ear, detecting the qualitative excellence of the right ear link and of the left ear link, exchanging audio signals received from the transmission unit between the right ear unit and the left ear unit according to the detected the qualitative excellence of the right ear link and of the left ear link, selecting, as a function of the detected the qualitative excellence of the right ear link and the left ear link, as input to each of the stimulating means at least one of the audio signals received by the respective receiver unit from the transmission unit, the audio signals received from the other one of the right ear unit and the left ear unit, and mixtures thereof, and stimulating the user's right ear and the user's left ear according to the selected respective audio signals.

14. The method of claim 13, wherein, if the qualitative excellence of one of the right ear link and the left ear link is detected as being below a pre-set threshold value, the audio signals received via that one of the right ear link and the left ear link having the higher the qualitative excellence is supplied as input to both of the stimulating means.

15. The method of claim 14, wherein the audio signals received via that one of the right ear link and the left ear link having the lower quality is prevented from being supplied as input to any of the stimulating means.

16. The method of claim 13, wherein a wireless binaural audio link is established between the right ear unit and the left ear unit for said exchanging of audio signals received from the transmission unit between the right ear unit and the left ear unit.

17. The method of claim 16, wherein said wireless binaural audio link is digital.

18. The method of claim 16, wherein said wireless binaural audio link is established once the qualitative excellence of one of the right ear link and the left ear link is detected as being below a pre-set threshold value.

19. The method of claim 13, wherein the qualitative excellence of the right ear link and of the left ear link are determined by measuring at least one of a signal-to-noise ratio, a Received-Signal-Strength-Indication (RSSI) value and an error rate.

20. The method of claim 13, wherein one of the right ear unit and the left ear unit acts as a master unit and the other one acts as a slave unit in order to select the audio signals to be provided as input to each of the stimulating means, wherein information regarding the qualitative excellence of the audio link to the slave unit is transmitted from the slave unit to the master unit, and wherein control commands regarding said input selection of the stimulating means are transmitted from the master unit to the slave unit.

21. The method of claim 13, wherein the right ear audio link and the left ear audio link are analog FM links or digital links.

22. System according to claim 1, wherein the audio signal source is an external audio signal source.

23. Process according to claim 13, wherein the audio signal source is an external audio signal source.

* * * * *